United States Patent [19]

Fegley

[11] 4,090,644

[45] * May 23, 1978

[54] FLUID DISPENSING ANTI-BURGLAR BOOBY TRAP DEVICE

[76] Inventor: Charles R. Fegley, 1606 Frush Valley Rd., Laureldale, Pa. 19605

[ * ] Notice: The portion of the term of this patent subsequent to Apr. 23, 1991, has been disclaimed.

[21] Appl. No.: 677,686

[22] Filed: Apr. 16, 1976

[51] Int. Cl.[2] ..... B65D 83/14

[52] U.S. Cl. ..... 222/180; 222/402.14; 222/402.15

[58] Field of Search ..... 222/180, 183, 402.14, 222/402.15, 402.24, 509, 505, 402.11, 402.21, 507; 239/274

[56] References Cited

U.S. PATENT DOCUMENTS

| | | | |
|---|---|---|---|
| 2,772,819 | 12/1956 | Poarch et al. | 222/509 X |
| 2,953,283 | 9/1960 | Palkowski | 222/505 X |
| 3,081,918 | 3/1963 | Scoggin, Jr. et al. | 222/402.15 X |
| 3,273,756 | 9/1966 | Levy et al. | 222/180 |
| 3,806,000 | 4/1974 | Fegley | 222/180 |

FOREIGN PATENT DOCUMENTS

| | | | |
|---|---|---|---|
| 1,949,235 | 4/1971 | Germany | 239/274 |

*Primary Examiner*—Robert B. Reeves
*Assistant Examiner*—Charles A. Marmor

[57] ABSTRACT

A fluid dispensing anti-burglar booby trap device is disclosed which discharges a fluid, containing a chemical such as tear gas, into an area to be protected when an intruder opens a window or door, by force if required, to enter a private or unauthorized area with which the device is associated. The anti-burglar booby trap device employs an actuating member for causing the discharge of a pressurized fluid container. The actuating member may be re-positioned to place the device in a safe, deactivated, non-actuatable condition when desired.

4 Claims, 13 Drawing Figures

FLUID DISPENSING ANTI-BURGLAR BOOBY TRAP DEVICE

BACKGROUND OF THE INVENTION

The invention relates generally to an anti-burglar booby trap device; more particularly to an anti-burglar device which dispenses a fluid containing a chemical such as tear gas from a container containing fluid under pressure, one type being an aerosol container, into a protected area upon actuation by an unauthorized person. This action causes the protected area to be flooded with a chemical, thereby, forcing evacuation of the protected area by the intruder; however, the invention is not limited to the use of the aerosol type container.

Chemical weapons have been known in the art for many years. One type of chemical weapon is the conventional tear gas grenade in which the firing member is generally triggered manually and the grenade is manually hurled at a target area, causing the target area to be flooded with the chemical irritant.

In another type of chemical weapon, the chemical irritant is stored under pressure in an aerosol type container. The firing member is again generally triggered manually and the chemical irritant in the form of a spray is manually directed at a target.

A third type of chemical anti-burglar device discharges an explosive tear gas shell into an area but this type is both dangerous and very limited as to the amount of tear gas which is discharged into the area to be protected.

Thus, what is needed is an anti-burglar device of the fluid dispensing booby-trap type which can be actuated by a small amount of mechanical force, yet will release a sufficient amount of fluid containing a chemical into a given area to force evacuation of an intruder. The anti-burglar device uses a container of pressurized fluid having a fluid-dispensing element which is actuated by an actuating member. The actuating member will actuate the dispensing element when a force is applied to the actuating member. Such a force may be the force of an opening door or window sash. By movement of the actuating member or parts thereof, the actuating member can be placed in a position so that the dispensing element cannot be accidentally actuated. When the device is triggered by an intruder moving a door or window sash, the actuating member causes actuation of the dispensing element to release a sufficient volume of a fluid such as tear gas from the pressurized container into the protected area to force evacuation of the intruder.

SUMMARY OF THE INVENTION

The principal object of the present invention is to provide an anti-burglary device of the fluid dispensing type which may be triggered directly by a small amount of mechanical movement, and yet may easily be placed in a non-actuatable condition.

An additional object of the invention is to provide an anti-burglar device of the chemical weapon type which is readily triggered by opening a window or other entry means by an intruder entering an unauthorized area.

Another object of the invention is to provide an improved means of discharging a fluid containing a chemical into the protected area in a minimum amount of time in order to force the intruder from the protected area and to prevent the intruder from re-entering the protected area for a reasonable amount of time.

Yet another object of the invention is to provide an anti-burglar device having means for reloading the device and resetting the actuating member of the weapon to its actuatable position after the device has been discharged. According to the principal aspect of the present invention, there is provided an improved means of actuating the fluid-dispensing element of an aerosol container. One such means is an actuating member mounted in relation to the fluid-dispensing element, whereby the fluid-dispensing element is actuated by the actuating member when moved by an object with which the invention is associated, when the actuating member is so positioned for such movement. The actuating member may be positioned so that it will allow an object such as a window to be moved freely without causing movement of the actuating member. Since the actuating member may be mounted relative to the dispensing element with mechanical advantage, the device can require little force for operation.

The body member of the invention is structured to support a pressurized container having a fluid-dispensing element whereby movement of the actuating member which is mounted relative to the fluid-dispensing element causes discharge. The device may be placed in a safe non-actuatable condition by moving the actuating member wherein it cannot actuate the fluid-dispensing element When actuated by the moving object, with which the device is associated, the object must remain in the actuated position to cause discharge. This can be accomplished by confining the movement of the object, such a window in its frame, so that an opposite movement of the object can be hindered by the actuating member.

The anti-burglar device utilizing such a fluid-dispensing element aerosol container may be structured to include a separate moveably mounted actuating member which can be moved from a safe non-actuatable position to an actuatable position for actuation by a moving object with which the device is associated. This type of actuating member requires a locking means whereby the device is locked in its actuated position, once actuated by the moving object, such as a door. This is accomplished by a spring biased catch associated with the actuating member which snaps into a locking position to prevent the return movement of the actuating member.

The anti-burglar device of the present invention may be utilized in homes, factories, farms, office buildings by attaching the device to doors, windows, skylights, etc. and may be used in connection with vehicles such as boats, trucks, etc. The device may also be employed for any other application wherein it is desired to prevent unauthorized persons from moving certain objects by mounting the device in such a manner that unauthorized movement of the objects will cause actuation.

Once actuated, the discharge cannot be stopped by the intruder and the entire amount of pressurized fluid will be discharged into the protected area making it impossible for the intruder to remain in the protected area without having protective equipment.

Other objects, aspects, and advantages of the invention will become apparent from the following description taken in connection with the accompanying drawings.

DESCRIPTION OF THE PREFERRED EMBODIMENTS

Figure 1:
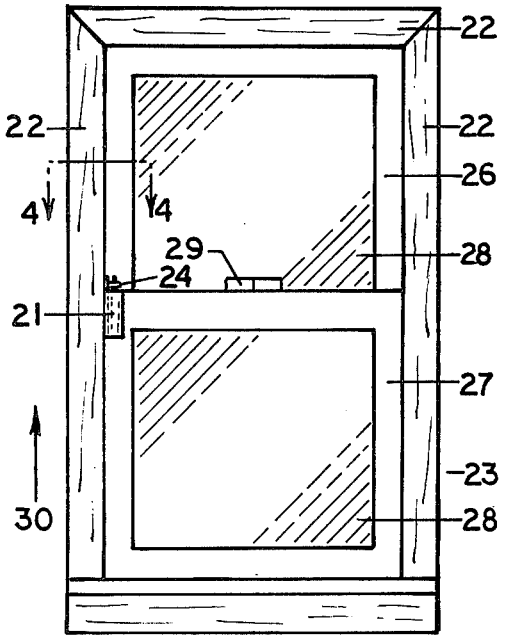
FIG. 1 is an elevational view of a wall of a room having one embodiment of the fluid dispensing anti-burglary device mounted on a window frame for actuation by an unauthorized movement of the window sash.

Referring now to the drawings in detail, wherein like reference characters designate like parts throughout the various views, there is shown in FIGS. 1 and 3-6, one form of the fluid dispensing anti-burglar booby trap device, called device hereafter, of the fluid dispensing type according to the present invention, generally designated 21. The device 21 is shown for convenience as being secured to a first surface such as a window frame 22 in wall 23 whereby the device can be actuated by movement of a movable second surface such as the window sash upon opening of the window sash 26 by an intruder. The device 21 will discharge a fluid 38 containing a chemical such as tear gas into the restricted area when actuated.

Figure 3:
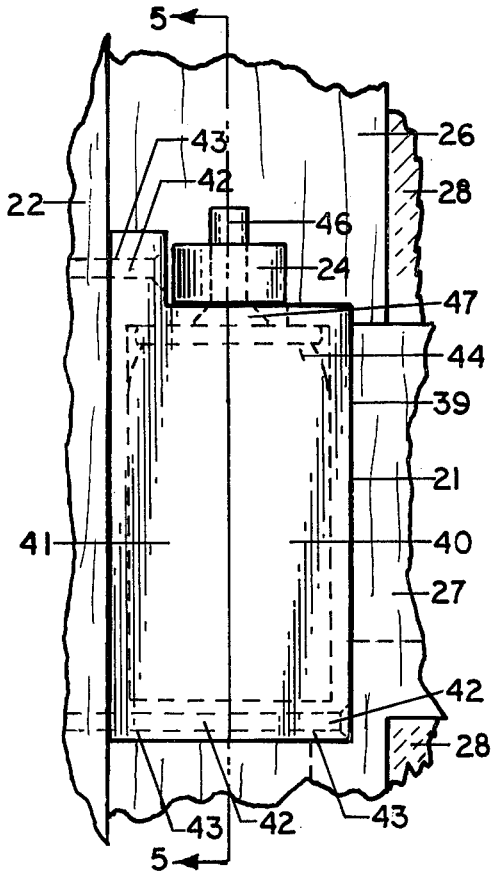
FIG. 3 is a front elevational view of the fluid dispensing anti-burglar device.

The device 21, whose front is shown in FIG. 3, contains a container of pressurized fluid, called pressurized container 44 hereafter, supported in a body member 39. The body member 39 is shown for convenience as being comprised of a front body half 40 and a rear body half 41 and includes mounting means which is shown for convenience as holes 43 through body member 39 for attaching device 21 to a first surface shown as the window frame 22 or elsewhere as may be convenient with screws 42.

Figure 13:
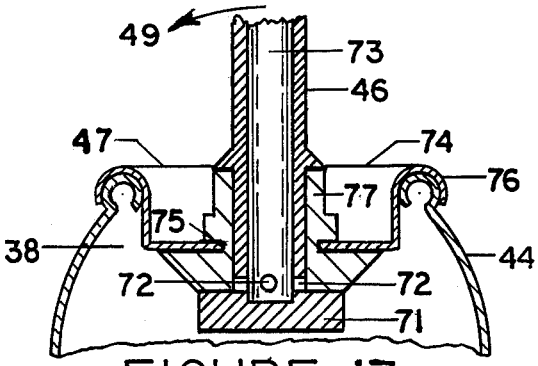
FIG. 13 is a partial vertical sectional view of the container valve assembly as taken along line 5—5 of FIG. 3.
Figure 10:
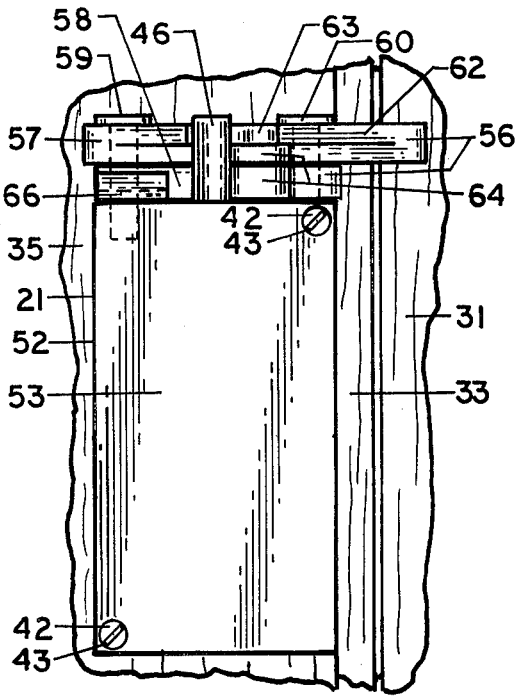
FIG. 10 is front elevational view of the second embodiment of the device.

As best seen in FIGS. 3-6, the body halves 40 and 41 when assembled form the pressurized container cavity 45 and body member opening 50. The pressurized container 44 is supported in the cavity 45. One type of pressurized container 44 is shown as having a fluid-dispensing element 46 for use with the valve assembly generally designated 47. Valve assemblies of this type are well known in the trade and one type of valve for use in this embodiment is shown in FIG. 13. The valve assembly 47 is shown in FIG. 13 and is comprised of a projecting fluid-dispensing element 46 which has a hollow tube portion 73 and is closed at the valve end 71 thereof. The fluid-dispensing element 46 is mounted in the hole 75 of the formed valve mounting container cover 74 by the grommet-like seal 77. The formed valve mounting container cover is attached to container 44 by the crimped seal 76. The hollow tube portion 73 of the fluid-dispensing element 46 has at its sealed valve end 71 four small discharge holes 72 so that when the dispensing element 46 is tilted from its normal position in any direction 49 the valve end 71 of the fluid-dispensing element 46 will part from the seal 77 on the side facing the direction 49 and allow the fluid 38 to flow between the valve end 71 and seal 77 through one or more of the discharge holes 72 and through the tube portion 73 of the fluid-dispensing element 46 into the area being protected. If the fluid-dispensing element 46 is allowed to return to its normal position the valved end 71 thereof again fully engages the seal 77 to prevent fluid flow. It is therefore readily seen why once tilted, the fluid-dispensing element 46 must be kept in that position until the container's contents has been dispensed.

Figure 4:
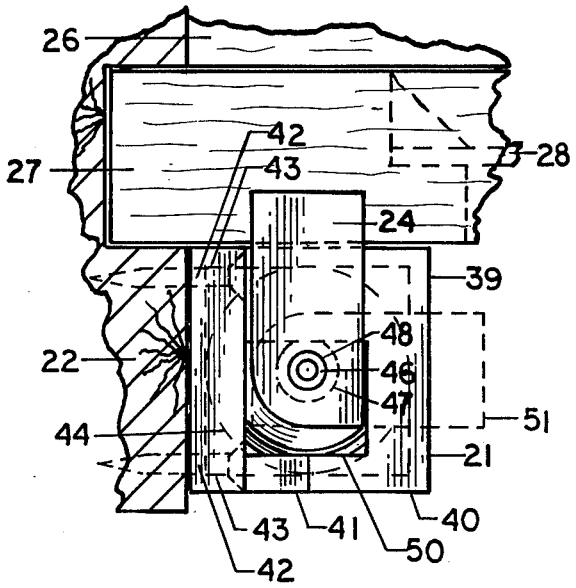
FIG. 4 is a top plan view of the device and a partial cross sectional view of its mounting as viewed along line 4—4 of FIG. 1.

One type of fluid-dipensing element actuating member 24, best seen in FIGS. 3-6, is shown as being mounted on the fluid-dispensing element 46 and may be secured to it by cement or other means. The fluid-dispensing element actuating member 24 or the container 44 or both should have means for positioning the fluid-dispensing element actuating member 24 by rotation between an actuatable position and free access position shown by the dotted line 51 as best seen in FIG. 4. The free access position permits safe entry without causing fluid discharge. The shape of the fluid-dispensing element actuating member 24 is such that when in the actuatable position, shown in FIG. 4, it can readily be actuated by an upward movement of the window sash 27 to cause the fluid-dispensing element actuating member 24 and dispensing element 46 to cause fluid discharge. The short end of the fluid-dispensing element actuating member 24 is free to move into the opening 50 of the body member 39 for easy operation of the valve assembly 47. However, when the fluid-dispensing element actuating member 24 is moved to position 51 as permitted by the radius on its short end, the device 21 is placed in a free access position. The window sash 27 may be moved without the actuation of the device 21 and the device 21 cannot be triggered in any fashion when in the free access position. The latter is again accomplished by the shape of the fluid-dispensing element actuating member 24 and limited confines of the body member opening 50.

Figure 5:
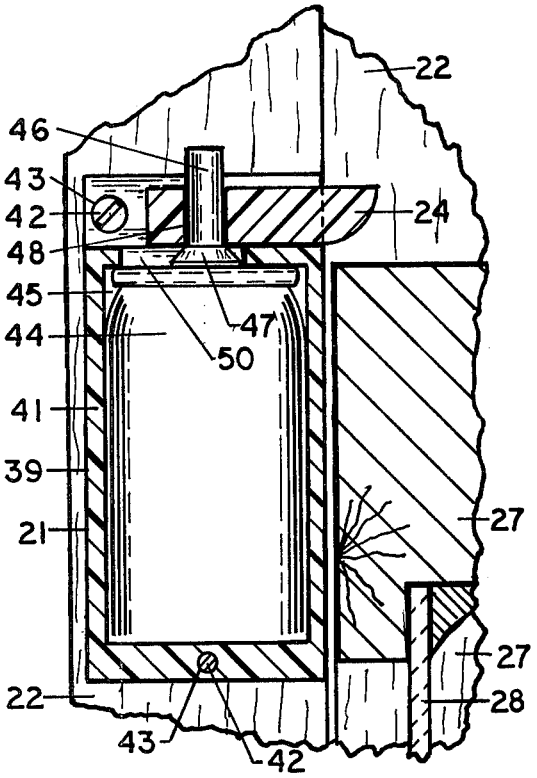
FIG. 5 is a vertical sectional view taken along line 5—5 of FIG. 3.
Figure 6:
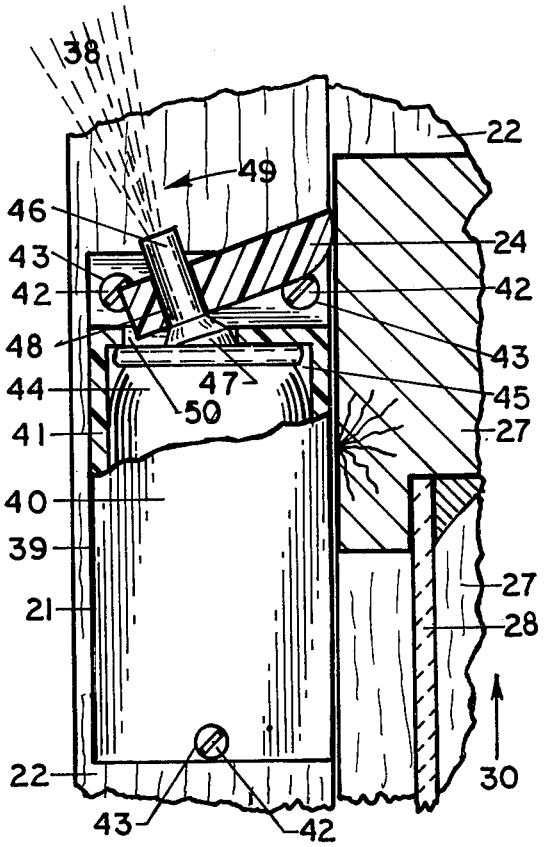
FIG. 6 is a vertical sectional view similar to FIG. 5 but showing the device in its actuated, dispensing condition.

The actuation of the device 21 to cause dispensing of the fluid 38 is best illustrated by the cross-sectional views of the device 21 in FIGS. 5 and 6. In FIG. 5, the fluid-dispensing element actuating member 24 is in the actuatable position as previously shown in FIGS. 3 and 4 poised above the window sash 27. In FIG. 6 the window sash 27 has moved upward in direction 30 in window frame 22 to cam the end of the fluid-dispensing element actuating member 24 in the same direction to cause the motion of the fluid-dispensing element 46 in direction 49 to operate the valve assembly 47 to cause the fluid 38 of the container 44 to be dispensed in the area being protected by the device 21. It is an important feature that the end of the fluid-dispensing element actuating member 24 present a flat surface to the actuating surface (second surface) of the window sash 27 so that the sash's action upon the actuating member 24 will not cause it to swing out of way in a direction normally used to place the device in the free access position. Another feature of the actuating member 24 is that once actuated as shown in FIG. 6 if the window sash 27 is moved in a direction opposite of direction 30 the actuating member will wedge lock the window sash 27 from being returned to its starting position. This keeps the device in a dispensing condition once actuated.

As previously described, the short end of actuating member 24 entering the confines of opening 50 can be best seen in FIG. 6. This confinement of two of the vertical sides of the actuating member 24, its rounded long side by the back body half 41 and its long flat side at one end by the opening 50 in the body member 39 further prevents movement by twisting of the actuating member 24 toward the free access position 51.

Once the device 21 has been actuated to dispense the fluid 38 of the container 44 through the valve assembly 47, the device 21 can be refurbished by disassembly of the two body halves 40 and 41 from the frame 22, the removal of the actuating member 24 from the dispensing element 46 of the expended container 44 and its re-installation on a replacement container and the reassembly of the device 21 to wall 22 containing the replacement container in container cavity 45 as shown in FIGS. 3–6.

A second embodiment of the invention is illustrated in FIGS. 2, 7–12. In this embodiment the basic structure is as previously described and like numbers are used to indicate like or corresponding parts. The basic structure has been modified to include an actuating member mounted independent from the dispensing element 46 which is self-latching.

In this embodiment, the pressurized container 44 and the dispensing element 46 thereof function to operate the valve assembly 47 as previously described, the major differences being the means used to move the dispensing element 46 in direction 49 to cause the dispensing of the fluid 38 from the container 44.

Figure 2:
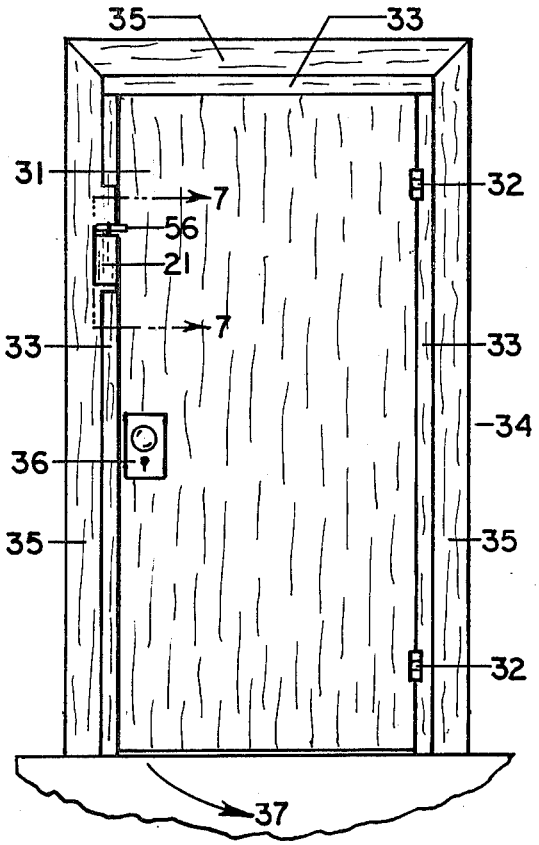
FIG. 2 is an elevational view of a wall of a room having the second embodiment of the fluid dispensing anti-burglar device mounted on a door frame for actuation by an unauthorized movment of the door.

In FIG. 2, the second embodiment of the device 21 is shown for convenience as being mounted on molding 35 of door frame 33 contained in wall 34. The devices actuating member 56 is shown in its actuatable position so that movement of the door 31 in direction 37 by an intruder will cause the device 21 to be actuated and dispense fluid 38 into the area being protected.

Figure 7:
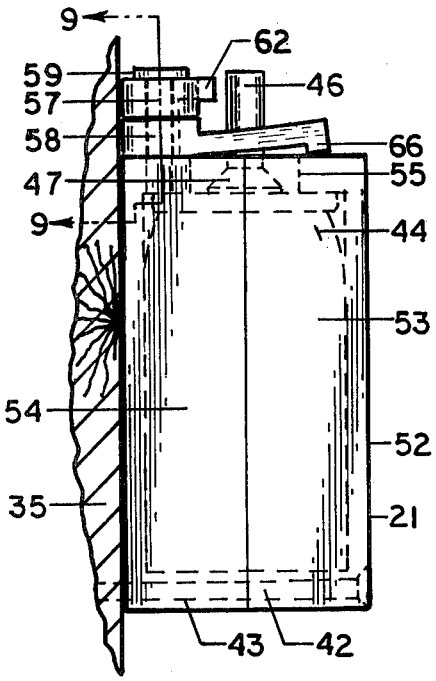
FIG. 7 is a left side elevational view of the second embodiment of the device as taken along line 7—7 of FIG. 2.
Figure 8:
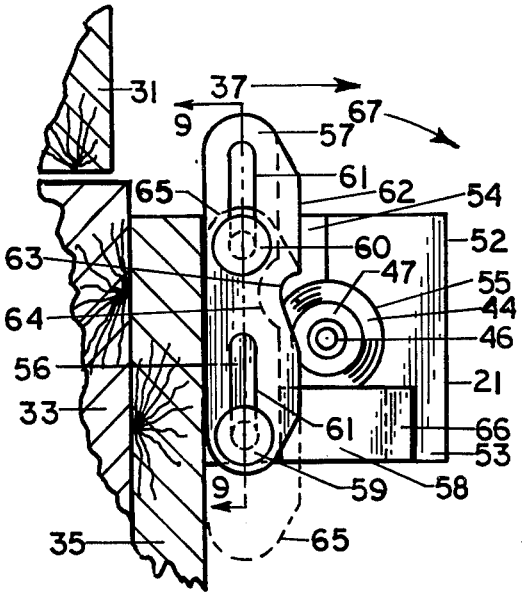
FIG. 8 is a top elevational of the second embodiment of the device in its ready-to-be actuated position.

The body member 39 of the first embodiment consisting of front body half 40 and rear body half 41 has been replaced by body memer 52 consisting of front body half 53 and back body half 54 as best seen in FIGS. 7 and 8. The body halves 53 and 54 form the container cavity 45 to support the pressurized fluid container 44 and are assembled by the assembly and mounting screws 42 passing through body half and member holes 43. In FIGS. 7–12, the actuating member 56 is shown in its actuatable and actuated positions. The actuating member 56 consists of a slidably mounted trigger element 57 mounted on a trigger pivoting element 58. The pivot and slide pin 60 and slide pin 59 secure the slidable trigger element 57 to the trigger pivoting element 58 through slots 61 of the trigger element 57 and pressed into pivot pin hole 68 of back body half 54 and slide pin hole 70 of the trigger pivoting element 58. The trigger element 57 may be moved between the actuable position shown in FIGS. 8–12 and the free access position 65 shown in FIG. 8, indicated dotted. In the free access position 65 the trigger element 57 of actuating member 56 cannot be acted upon by the door 31 moving in direction 37 to actuate the device 21.

Figure 9:
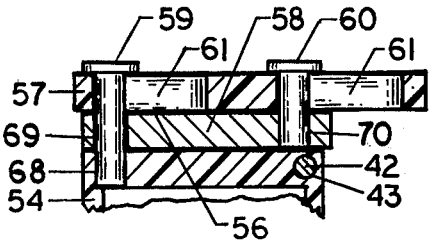
FIG. 9 is a vertical sectional view of the actuating member of the second embodiment of the device as viewed along line 9—9 of FIGS. 7 and 8.
Figure 12:
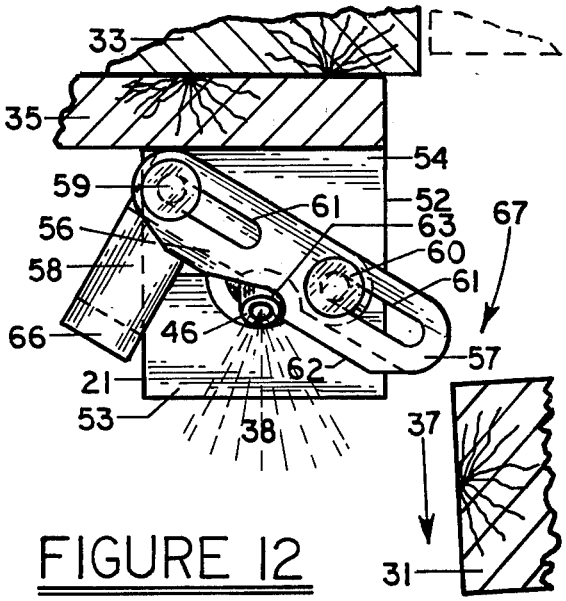
FIG. 12 is a top elevational view of the second embodiment of the device similar to FIG. 8 but showing the device in its actuated, dispensing condition.
Figure 11:
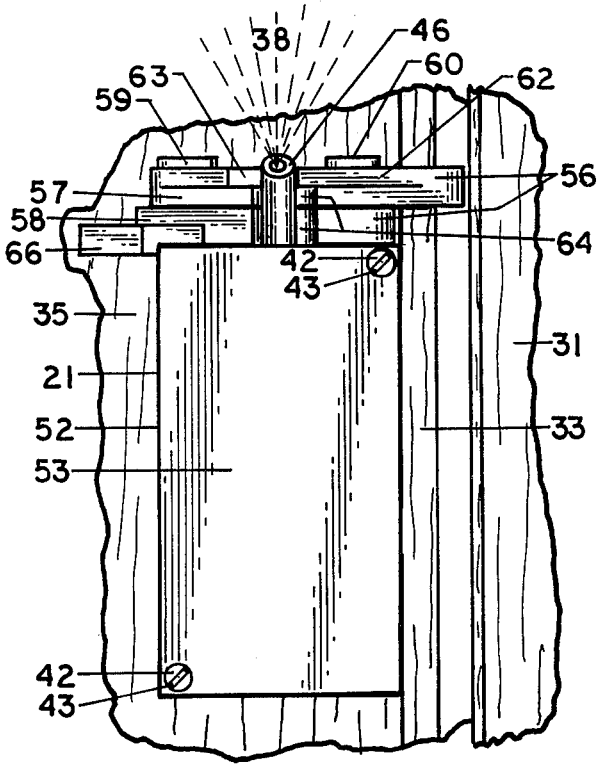
FIG. 11 is a front elevational view of the second embodiment of the device similar to FIG. 10 but showing the device in its actuated, dispensing condition.

The trigger element 57 has an actuating projection 62 whose fluid-dispensing element guide notch 63 serve to actuate the fluid-dispensing element 46 to dispense fluid 38 upon actuation and to guide the fluid-dispensing element 46 to move in a direction away from the mounting surface molding 35 as best seen in FIGS. 8, 11 and 12. Similarly, the L-shaped trigger pivoting element 58 which is mounted on body half 54 by pivot and slide pin 59 has dispensing element clearance 63 to permit the trigger element 57 to move the fluid-dispensing element 46 to a desirable dispensing position as previously shown in FIG. 6, and as best seen in FIGS. 11 and 12 for this embodiment. The assembly of the actuating member 56 is best seen in FIG. 9.

The L-shaped trigger element 58 provides a means for slidably mounting the trigger element 57. A locking projection 66 to secure the trigger-actuating member 56 and therefore lock the fluid-dispensing element 46 in an actuated, dispensing condition to completely dispense the fluid 38 from the pressurized container 44 is shown in FIGS. 9 and 12. Now referring to FIGS. 7, 8 and 10–12, it can be seen that the trigger element 57 when in the actuatable position will be moved by the door. The trigger element 57 of the actuating member 56 will rotate the actuating member 56 in direction 67 thereby moving the dispensing element 46 in direction 49 and causing fluid discharge. The actuating member 56 is locked in position and prevented from returning to the position 65 by the mounting surface of molding 35 as best seen in FIG. 12. Once the door 31 has moved the actuating member 56 far enough to fully actuate the dispensing element 46 in direction 49, the actuating member locking projection 66 is spring biased to move to the locked position seen in FIGS. 11 and 12. The projection 66 engages the one side of the front body half 53 of body member 52 to keep the actuating member 56 in a dispensing condition to dispense the fluid contents 38 of pressurized fluid container 44.

The embodiments herein show the pressurized container having the fluid-dispensing element positioned in the upmost position for use with fluids in gaseous form. It is recognized that by inverting the device, fluids in liquid form may be discharged.

Although I have herein shown and described the invention in what I have conceived to be the most practical and preferred embodiments, it is recognized that the scope of my invention, which is not to be limited to the details disclosed herein but is to be accorded the full scope of the claims so as to embrace any and all equivalent structures and devices.

I claim:

1. A fluid dispensing anti-burglary booby trap device for attachment to a first surface such as a wall wherein said device is associated with a second surface such as a window and arranged that movement of said second surface will cause said device to dispense a fluid such as tear gas in the event unauthorized movement of said second surface is attempted, the device comprising:

(a) a body member;

(b) a container of pressurized fluid supported in said body member, said container having a fluid-dispensing element adapted to release fluid under pressure when actuated;

(c) a passageway in said fluid-dispensing element for directing fluid from said container;

(d) means for actuating said fluid-dispensing element, said dispensing element actuating means mounted for movment and associated with said fluid-dispensing element and said second surface, said dispensing element actuating means actuating said fluid-dispensing element when it is moved by said second surface, thereby causing fluid discharge;

(e) means for movably positioning said dispensing element actuating means whereby said dispensing element actuating means may be positioned between an inactuatable position and an actuatable position, said dispensing element actuating means in said inactuatable position permitting movement of said second surface without causing movement of said dispensing element actuating means, said dispensing element actuating means when in said actuatable position being in position to be moved upon unauthorized movement of said second surface;

(f) mounting means associated with said body member for fastening said body member to said first surface, said body member arranged on said first surface relative to said second surface whereby movement of said second surface from a first position to a second position will engage with and move said dispensing element actuating means when said dispensing element actuating means is in said actuatable position, said dispensing element actuating means including a wedge means which will wedge lock said second surface to prevent said second surface from returning to its first position to restrict movement of said second surface while maintaining fluid flow from said container.

2. The fluid-dispensing anti-burglar device of claim 1 wherein said fluid-dispensing element includes a dispensing valve which is actuated upon movement thereof to permit fluid discharge therethrough.

3. The fluid-dispensing anti-burglar device of claim 1 wherein said fluid-dispensing element includes a projecting dispensing spout, said dispensing spout discharging fluid upon movement thereof.

4. The fluid-dispensing anti-burglar device of claim 1 wherein said means for movably positioning said dispensing element actuating means includes the rotatably mounting of said dispensing element actuating means on said fluid-dispensing element whereby said dispensing element actuating means may be rotated between said inactuatable position and said actuatable position.

* * * * *